US008377521B2

(12) United States Patent
Stork et al.

(10) Patent No.: US 8,377,521 B2
(45) Date of Patent: Feb. 19, 2013

(54) INK JET RECORDING MATERIAL

(75) Inventors: Gerhard Stork, Flensburg (DE); Karsten Lerius, Munkbrarup (DE)

(73) Assignee: Mitsubishi HiTec Paper Flensburgh GmbH, Flensburg (DE)

( * ) Notice: Subject to any disclaimer, the term of this patent is extended or adjusted under 35 U.S.C. 154(b) by 1724 days.

(21) Appl. No.: 11/478,167

(22) Filed: Jun. 29, 2006

(65) Prior Publication Data

US 2007/0002120 A1 Jan. 4, 2007

(30) Foreign Application Priority Data

Jun. 29, 2005 (EP) ..... 05014012

(51) Int. Cl.
*B41M 5/50* (2006.01)

(52) U.S. Cl. ..... 428/32.18; 428/32.28; 428/32.37

(58) Field of Classification Search ..... None
See application file for complete search history.

(56) References Cited

U.S. PATENT DOCUMENTS

| | | | | |
|---|---|---|---|---|
| 5,843,549 | A * | 12/1998 | Mingus | 428/40.1 |
| 5,911,855 | A | 6/1999 | Dransmann et al. | |
| 6,156,419 | A | 12/2000 | Brugger et al. | |
| 6,485,812 | B1 | 11/2002 | Sekiguchi | |
| 6,524,696 | B1 | 2/2003 | Gumbiowski | |
| 7,500,743 | B2 * | 3/2009 | Takashima | 347/100 |
| 2002/0045035 | A1 | 4/2002 | Nojima | |
| 2004/0209010 | A1 | 10/2004 | Cuch | |
| 2004/0219310 | A1 | 11/2004 | Ogata | |
| 2005/0053735 | A1 | 3/2005 | Beer et al. | |

FOREIGN PATENT DOCUMENTS

| | | | |
|---|---|---|---|
| DE | 196 01 267 | | 7/1997 |
| DE | 19601267 | | 7/1997 |
| DE | 199 52 356 | | 5/2000 |
| EP | 0 701 904 | | 3/1996 |
| EP | 0701904 | | 3/1996 |
| EP | 0 732 219 | A2 | 9/1996 |
| EP | 0 803 375 | A1 | 10/1997 |
| EP | 0 806 299 | A2 | 11/1997 |
| EP | 0 810 101 | A1 | 12/1997 |
| EP | 0 875 394 | A1 | 11/1998 |
| EP | 1 512 544 | A1 | 3/2005 |
| JP | 11138978 | | 5/1999 |

* cited by examiner

*Primary Examiner* — Bruce H Hess
(74) *Attorney, Agent, or Firm* — Cozen O'Connor

(57) ABSTRACT

An ink-jet recording paper with a paper substrate that has a coating on at least one side, wherein the coating contains binder and inorganic pigment, and wherein:

(a) the substrate has a density in the range of 0.6 to 1.0 g/cm$^3$ and a Cobb$_{60}$ value in the range of 19-25 g/m$^2$;

(b) the coating consists solely of a single layer formed as a recording layer, which is applied directly to the substrate;

(c) the pigment present in the recording layer consists of colloidal synthetic boehmite with a mean crystal size in the range of 10-50 nm; and (d) the binder present in the recording material consists of silanized polyvinyl alcohol to the extent of 80-100 wt. %.

17 Claims, No Drawings

INK JET RECORDING MATERIAL

BACKGROUND OF THE INVENTION

The present invention concerns an ink-jet recording material with a paper substrate that has a coating on at least one side. The coating contains binder and inorganic pigment.

Ink-jet recording materials, including especially those with a paper substrate, are widely known in the prior art.

Previously known ink-jet recording materials usually have a multilayer coating that consists of at least one ink-receiving layer and at least one protective layer, with the one or more protective layers formed above the one or more ink-receiving layers. An intermediate layer joined with the ink-receiving layer is very often additionally provided directly on the substrate.

The essential components of the previously known ink-receiving layers are inorganic pigments and binders. Especially silicon dioxide and the hydroxides and oxides of aluminum are widely used as pigments, and polyvinyl alcohol is widely used as a binder.

EP 0 806 299 A discloses an ink-jet recording paper with an ink-receiving layer and an upper layer that covers the ink-receiving layer. Whereas the ink-receiving layer does not contain any pigments, the upper layer contains inorganic pigment particles. Aluminum hydroxide of the boehmite type with a pore radius distribution of 10-35 Å or 1 to 3.5 nm is cited as an example of an inorganic pigment. Especially barite-coated or polyolefin-coated papers are used as substrates.

DE 19 952 356 A likewise describes an ink-jet recording paper with a multilayer coating. This paper has an ink-receiving layer with fine inorganic particles and a binder resin as a first layer on at least one side of its substrate. The ink-receiving layer is then coated or impregnated with a coating liquid in the form of a cover layer and then dried. The coating liquid contains at least one specific tetraalkoxytitanium dissolved in an organic solvent. Fine inorganic particles that may be used in the ink-receiving layer include, for example, synthetic amorphous silica, kaolin, talc, calcium sulfate, barium sulfate, titanium dioxide, zinc oxide, zinc sulfide, zinc carbonate, aluminum hydroxide, aluminum oxide, and alumina hydrate (pseudoboehmite sol), either individually or in combination. The use of alumina hydrate or colloidal silica as fine inorganic particles is described as preferred, and an alumina hydrate with a pseudoboehmite structure is especially preferred.

EP 0 732 219 A proposes a printing medium in which an ink-receiving layer is provided on a liquid-absorbing paper substrate. The ink-receiving layer is covered by a surface layer. The ink-receiving layer consists of a binder and a cationic substance, while the surface layer consists of ultrafine cationic particles of aluminum oxide or alumina hydrate with a particle diameter in the range of 1-500 nm. A glossiness of 45% or more at an angle of view of 75° is disclosed for the surface layer. Aluminum oxide and alumina hydrate are among a large number of substances specified as inorganic pigments of the ink-receiving layer. Organic particles may also be present. A suitable range of particle sizes is given as 0.1 to 20 μm, which corresponds to 100 to 20,000 nm.

EP 0 803 375 A discloses a recording material, especially for ink-jet printing, whose substrate has a porous recording layer that contains both nonionic or cationic water-insoluble resin particles and alumina hydrate particles, with boehmite with a secondary agglomerated particle size of 100-200 nm being preferred. During the production of the recording layer, it is dried in contact with a smooth surface. The recording layer may additionally be covered with a layer of silicon dioxide to improve scratch resistance.

EP 0 810 101 A discloses a recording material with a porous ink-receiving layer, which can contain both the pure hydroxides of aluminum and pure aluminum oxide, including alumina hydrate with a boehmite structure, with the microcrystals of the alumina hydrate oriented with a specific degree of parallelism. One of the objectives of the invention is to make available a recording material with a high degree of glossiness. Values in the range of 51% to 68% are given as examples.

EP 0 875 394 A discloses the use of alumina hydrate that has been treated with rare-earth salts to produce the recording layer of an ink-jet recording material.

Finally, in a recent proposal aimed at improving the shelf life and increasing the printing speed of ink-jet recording materials, EP 1 512 544 A discloses the addition of polynuclear aluminum hydroxo complexes to nanocrystalline inorganic compounds contained in the recording layer. Pseudoboehmite and silicon dioxide with a maximum particle size of 20 nm are especially preferred as these compounds, and the document specifies that they should have a pore volume≧20 mL/100 g. In addition to the nanocrystalline, nanoporous inorganic compounds, the recording layer can also contain other inorganic compounds that are not nanoporous and nanocrystalline as defined above. In addition to one or more disclosed recording layers, the cited document also provides for auxiliary layers. Suitable substrates include especially polyester foils and—if paper is to be used—preferably barite-coated or polyolefin-coated paper. Uncoated papers of various types can also be used, although no information is given regarding their composition and properties. The only comment that can be made here is that they can have large differences.

The prior-art recording materials are aimed for the most part at the high-price sector with very high surface standards, which can be explained by the fact that there is growing demand for high-quality printing stock for color photo printing due to recent rapid increases in the use of digital photography.

However, there is also growing demand for ink-jet recording materials used in everyday business applications, which means, on the one hand, that it should be possible to produce them less expensively than the aforementioned printing stock for digital photography, and, on the other hand, that they should have a significantly higher quality standard than, for example, the simple copying papers that are still widely used. In particular, for ink-jet recording materials to be successfully used in business applications, it should be possible to print them at very high printing speeds with ink-jet printers, and it should be possible to guarantee not only a long shelf life but also good stability of the ink-jet print image towards environmental influences. In any event, the range of applications encompassed by the "business sector" requires costs that are appropriate for these applications. This requires both quantitative limitation of the raw materials that are used and minimization of the production costs.

The prior-art multiple-step processes for the application of several layers conflict with this objective, as does the use of high-cost materials, which, in addition, often require expensive preparation before they are used in the process.

SUMMARY AND DESCRIPTION OF THE INVENTION

The objective of the present invention is to make available to the public an ink-jet recording material which meets the aforementioned requirements and, in particular, has:

a high degree of stability of both the ink-jet print image and the unprinted ink-jet recording material towards environmental influences, for example, towards the ozone present in the atmosphere;

sufficient stability of the ink-jet print image towards moisture and water;

a good cost-performance ratio; and high-speed printability by ink-jet printers.

In accordance with the invention, it was then generally recognized that the goals of the invention can be achieved if, in an ink-jet recording material with a substrate, the coating to be directly applied to the substrate is produced with only a single layer. The substrate that is used must then at least partially perform the function that is taken care of by the system of several layers in prior-art ink-jet recording materials. Therefore, the selection of a suitable substrate is especially important in the context of the present invention.

In particular, therefore, to solve the problem at hand, the invention provides an ink-jet recording material with a paper substrate that has a coating on at least one side, wherein the coating contains binder and inorganic pigment. The ink-jet recording material of the invention is characterized by the fact that:

(a) the substrate has a density in the range of 0.6 to 1.0 g/cm$^3$ and a Cobb$_{60}$ value in the range of 19-25 g/m$^2$;

(b) the coating consists solely of a single layer formed as a recording layer, which is applied directly to the substrate;

(c) the pigment present in the recording layer consists of colloidal synthetic boehmite with a mean crystal size in the range of 10-50 nm; and (d) the binder present in the recording material consists of a silanized polyvinyl alcohol to the extent of 80-100 wt. %.

In accordance with the invention, the boehmite can also be present in the recording layer as a pigment mixture of different types of boehmite, in which case the feature of a mean crystal size in the range of 10-50 nm then applies to all of the types of boehmite.

Additional preferred embodiments of the ink-jet recording paper of the invention are described below.

In the production of the substrate, the choice of eucalyptus pulp as the principal pulp used with a preferred weight fraction of 75-100 wt. % (absolutely dry), based on the total pulp content of the substrate, and especially the adjustment of the freeness for the pulp in the range of 25-30° Schopper Riegler (SR) lead to an absorbent paper, whose substrate with a Cobb$_{60}$ value in accordance with the invention in the range of 19-25 g/m$^2$ is essential for absorption of the liquid constituents of the ink-jet ink printed on the recording layer and for fixing the ink. A substrate whose pulp consists entirely of eucalyptus pulp is especially preferred.

It was recognized as essential to the invention that the density of the substrate must also be in the range of 0.6 to 1.0 g/cm$^3$ due to the not very highly beaten pulp, especially in order to realize rapid liquid absorption during printing of the recording layer with ink-jet ink.

In a preferred embodiment, the substrate of the proposed recording material has an inorganic pigment, and an added amount in the range of 2-10 wt. % (absolutely dry), based on the total solids content of the substrate, is especially recommended. Basically all known inorganic pigments can be used, preferably those selected from the group comprising natural and calcined kaolin, silicon dioxide, bentonite, calcium carbonate, and aluminum oxide (especially boehmite). However, calcium carbonate is especially preferred as the pigment incorporated in the substrate.

The substrate generally contains an internal size, and a resin size in a weight fraction of 0.4-0.6 wt. % (absolutely dry), based on the total solids content of the substrate, is especially preferred.

The uncoated substrate has a negligible glossiness of less than 5% as measured by TAPPI 450 or ISO 2813 at an angle of reflection of 75°. To guarantee, among other things, very good joining of the substrate with the single-layer recording layer applied to the substrate, a low smoothness of the substrate in the range of 5-50 Bekk sec is helpful.

In a preferred embodiment, the recording material of the invention is designed in such a way that a coating is applied directly to both sides of the substrate, with the coating on each side containing binder and inorganic pigment. This recording material is characterized by the fact that:

(a) each of the two coatings consists of only a single layer formed as a recording layer, which is applied directly to the substrate;

(b) the pigment present in each of the two recording layers consists of colloidal synthetic boehmite with a mean crystal size in the range of 10-50 nm; and (c) the binder present in each of the two recording layers consists of a silanized polyvinyl alcohol to the extent of 80-100 wt. %.

In accordance with the invention, the boehmite may also be present in the two recording layers in the form of a pigment mixture of different types of boehmite, in which case the feature of a mean crystal size in the range of 10-50 nm then applies to all of the types of boehmite.

It is especially preferred for both recording layers to be produced from the same coating compound and thus to have the same constituents in the same amounts and to be described by the same measured values. Practically all known coating devices can be used to apply the recording layer to one or both sides of the substrate, for example, those selected from the list comprising curtain coaters and spray coaters, film press and roll coater, air knife coater, doctor blade coater, and roll doctor. Especially a film press offers the advantage that it can be designed as a coating device that can apply a coating to both sides.

As an alternative to the preferred embodiment of two recording layers applied directly to both sides of the substrate, it is also possible for the substrate to have a recording layer applied directly to one side and a simple starch and/or pigment preparation on the other side. In a special variant of the latter embodiment, the preparation on the reverse side is crosslinked and contains at least one diisocyanate component, especially hexamethylene diisocyanate, as the crosslinking agent. In addition, the preparation on the reverse side preferably contains calcium carbonate as a pigment and at least one binder selected from the list comprising starch, styrene-butadiene latex, and carboxymethyl cellulose.

In the recording layer applied directly to one or both sides of the substrate, the use of an aluminum hydroxide of the boehmite type allows an unusually high printing speed, and the inventor assumes that the absorption capacity of the substrate of the invention plays an important role here. At a preferred mass per unit area of 7-12 g/m$^2$ and especially 8-10 g/m$^2$ for the recording layer applied directly to one or both sides of the substrate, the recording layer contains the aluminum hydroxide of the boehmite type in an amount of 6 to 8.5 g/m$^2$. At the same time, the silanized polyvinyl alcohol is preferably present in an amount of 0.6 to 0.85 g/m$^2$. The high pigment content compared to the content of binder in the recording layer applied directly to one or both sides of the substrate also helps to make a high printing speed possible. In an especially preferred embodiment, the recording layer applied directly to one or both sides of the substrate consists to the extent of at least 90 wt. % of a mixture of aluminum hydroxide of the boehmite type as pigment and binder. In this connection, the preferred pigment-binder ratio is in the range of 9:1 to 19:1 and especially in the range of 9.5:1 to 14.5:1. The remaining maximum 10 wt. % of each recording layer comprise necessary residual components, such as:

agents for pH adjustment;

stabilizing aids for adjustment with respect to gases present in the ambient air;

ink-fixing agents; and surface-active substances.

80-100 wt. % of the binder in the recording layer consists of silanized polyvinyl alcohol. Therefore, a maximum of 20 wt. % of additional binders can be present in the given recording layer. These additional binders are selected especially from the list comprising nonsilanized polyvinyl alcohol, starch, gelatin, polyacrylates, polyvinyl acetate copolymers, polystyrene-butadiene latices, and cellulose derivatives. It is especially preferred if the recording layer applied directly to the substrate or if the two recording layers applied directly to both sides of the substrate contain exclusively a silanized polyvinyl alcohol as the binder. In this connection, it is very especially preferred for the polyvinyl alcohol to have a degree of saponification of 98.5 ±0.5 mole %.

Surprisingly, in the embodiment of the recording layer that is preferred with respect to its mass per unit area and its pigment content, the recording layer still lets the substrate show through, which can also be explained by the deliberate and preferred absence of optical brighteners in one or both recording layers. Accordingly, the whiteness of the substrate also has a certain amount of importance. The whiteness is preferably in the range of 85-110%, as determined by ISO 2469 in conjunction with ISO 2470, and is optionally adjusted by the addition of optical brighteners to the substrate.

In a first variant, the aluminum hydroxide of the boehmite type, which represents the pigment incorporated in the recording layer applied directly to one or both sides of the substrate, has a mean crystal size in the range of 18-22 nm. The pigment preferably has a mean pore radius in the range of 85-110 Å or 8.5 to 11 nm. In accordance with this first variant, the boehmite preferably has a mean specific surface in the range of 135-165 $m^2/g$. In a second variant, the aluminum hydroxide of the boehmite type, which represents the pigment incorporated in the recording layer applied directly to one or both sides of the substrate, has a mean crystal size in the range of 34-43 nm. In accordance with this second variant, the boehmite preferably has a mean pore radius in the range of 180-220 Å or 18-22 nm and a mean specific surface in the range of 85-115 $m^2/g$. In both variants, the boehmite used in accordance with the invention in one or both recording layers preferably has a pore volume in the range of 0.5-0.9 mL/g, and especially 0.6-0.8 mL/g.

In a preferred embodiment of the proposed recording material, the pigment in the recording layer applied directly to one or both sides of the substrate consists of a pigment mixture, which consists of a boehmite of the first variant with a mean crystal size in the range of 18-22 nm and a boehmite of the second variant with a mean crystal size in the range of 34-43 nm. The preferred range of the mixing ratio of $\text{boehmite}_{variant\ 1}$:$\text{boehmite}_{variant\ 2}$ is 3:1 to 1:3.

The boehmite to be used in one or both recording layers consists of platelike primary particles with the specified mean crystal sizes. Secondary particles formed by agglomeration of the primary particles have a particle size in the range of 70-350 μm with a pore volume of 0.5-0.9 mL/g, and a pore volume of 0.6-0.8 mL/g is especially preferred.

Numerous series of tests were conducted to test the compatibility of metal salts with the formulation of a coating compound for forming the recording layer, with the result that metal salts fall short of the desired results in some cases. This is especially true of copper salts. On the other hand, it is preferred that an antioxidant, especially hexamethylenebis (dimethyl-carbazide), be incorporated in the recording layer directly applied to one or both sides of the substrate. An added amount in the range of 1-6 wt. % (absolutely dry), based on the total solids content of the given recording layer, is especially preferred.

The recording layer applied directly to one or both sides of the substrate ideally has a Bekk smoothness of 60-150 sec and a relatively low glossiness, so that the recording material can be designated to have a "satin finish" on one or both of its recording layers. The measured glossiness of the recording layer in a preferred range of 10-40%, as measured by TAPPI 450 or ISO 2813 at an angle of reflection of 75°, corresponds to the glossiness of high-quality commercial papers and gives the ink-jet recording material of the invention a more elegant appearance compared to simple writing or copying papers.

The following example further illustrates the invention:

A coating base paper with a grammage of 67 $g/m^2$ is produced on a Fourdrinier machine from a pulp stock which consists of eucalyptus pulp and has been beaten to 28° Schopper Riegler (SR). In the pulper upstream of the Fourdrinier machine, calcium carbonate is added as a filler to the pulp slurry in an amount of 5 wt. %, and resin size is added to the pulp slurry in an amount of 0.5 wt. %, based on the total solids content of the substrate.

A base stock web is produced from the mixture and is then dried and compressed by a calender. As the intended substrate for the proposed ink-jet recording material, it has a density of 0.8 $g/cm^3$, a $Cobb_{60}$ value of 21 $g/m^2$, and a smoothness of 40 Bekk sec.

In a separate coating installation, a roll coater is used in conjunction with an air brush to coat both sides of the base stock web, which serves as the substrate, with the coating compound according to Table 1. The coating is adjusted to a mass per unit area of 9 $g/m^2$.

TABLE 1

Formulation of the coating compound for producing recording layers, which are applied directly to both sides of the substrate.

| | Parts by weight (air-dried) | Wt. % (absolutely dry) |
|---|---|---|
| water | 218.59 | — |
| nitric acid 65% | 9.87 | 0.99 |
| aluminum hydroxide | 82.27 | 82.27 |
| hexamethylenebis(dimethylcarbazide) | 4.11 | 4.11 |
| silanized polyvinyl alcohol | 82.27 | 8.23 |
| pigment fixing agent | 13.71 | 4.11 |
| wetting agent | 2.88 | 0.29 |
| total absolutely dry | — | 100 |
| total air-dried | 413.71 | — |

The primary particles of aluminum hydroxide have a mean particle size of 19 nm. The mean specific surface is in the range of 135-165 $m^2/g$, while the mean pore radius is in the range of 8.5 to 11 nm. The silanized polyvinyl alcohol has a degree of saponification of 98.5±0.5 mole %.

After the paper web has been coated with the recording layer and dried, it is treated on a calender to obtain a glossiness of 35%, as measured by TAPPI 450 or ISO 2813 at an angle of reflection of 75°, and a smoothness of 80 Bekk sec.

The ink-jet recording material produced in this way can be produced less expensively than comparable recording materials due especially to the only single-layer formation of the recording layers applied on both sides. Printing tests using an Epson Stylus Photo 950 and additionally using a Hewlett-Packard 720 for purposes of comparison show very good printability, and full printed surfaces are smudge-proof after only about 2 sec.

To test the fastness of the print image to moisture and water, water was sprinkled on the print images for which the rapid drying time had already been evaluated. After exposure to water for 2 seconds, a finger is repeatedly wiped over the print image with constant pressure. Under these test conditions, the print image should be smeared as little as possible and, in the ideal case, not at all. Especially convincing results are also obtained in this test on the proposed recording materials.

The data provided in the specification and the claims with respect to grammage and mass per unit area, weight percent (wt. %), and parts by weight are based in each case on the "absolutely dry" weight, i.e., the parts by weight absolutely dry.

The invention claimed is:

1. Ink-jet recording material with a paper substrate that has a single coating on at least one side, wherein the coating contains binder and inorganic pigment, wherein:

(a) the substrate has a density in a range of 0.6 to 1.0 g/cm$^3$ and a $Cobb_{60}$ value in a range of 19-25 g/m$^2$;

(b) said single coating consists solely of a single layer formed as a recording layer, which is applied directly to the substrate;

(c) the pigment present in the recording layer consists of colloidal synthetic boehmite with a mean crystal size in a range of 10-50 nm; and (d) the binder present in the recording layer consists of silanized polyvinyl alcohol to an extent of 80-100 wt. %.

2. Ink jet recording material in accordance with claim 1, wherein pulp stock used to produce the paper has a Schopper Riegler (SR) freeness of 25-30°.

3. Ink jet recording material in accordance with claim 2, wherein the pulp stock consists of eucalyptus pulp to an extent of 75-100 wt. % (absolutely dry).

4. Ink-jet recording material in accordance with claim 1, wherein the pulp stock consists of eucalyptus pulp.

5. Ink jet recording material in accordance with claim 1, wherein a coating is applied to both sides of the substrate, with the coating on each side containing binder and inorganic pigment, and:

(a) each of the two coatings consists of only a single layer formed as a recording layer, which is applied directly to the substrate;

(b) the pigment present in each of the two recording layers consists of colloidal synthetic boehmite with a mean crystal size in the range of 10-50 nm; and (c) the binder present in each of the two recording layers consists of a silanized polyvinyl alcohol to the extent of 80-100 wt. %.

6. Ink jet recording material in accordance with claim 1, wherein the recording layer applied directly to one or both sides of the substrate has a mass per unit area of 7-12 g/m$^2$ and contains the boehmite in an amount of 6 to 8.5 g/m$^2$.

7. Ink-jet recording material in accordance with claim 1, wherein the boehmite has a mean crystal size in the range of 18-22 nm.

8. Ink jet recording material in accordance with claim 7, wherein the boehmite has a mean pore radius of 85-110 Å or 8.5 to 11 nm.

9. Ink-jet recording material in accordance with claim 7, wherein the boehmite has a mean specific surface in a range of 135-165 m$^2$/g.

10. Ink-jet recording material in accordance with claim 1, wherein the boehmite has a mean crystal size in the range of 34-43 nm.

11. Ink-jet recording material in accordance with claim 10, wherein the boehmite has a mean pore radius of 180-220 Å or 18-22 nm.

12. Ink-jet recording material in accordance with claim 10, wherein the boehmite has a mean specific surface in a range of 85-115 m$^2$/g.

13. Ink-jet recording material in accordance with claim 1, wherein the silanized polyvinyl alcohol is present in the recording layer applied directly to one or both sides of the substrate in an amount of 0.6 to 0.85 g/m$^2$.

14. Ink-jet recording material in accordance with claim 1, wherein the recording layer applied directly to one or both sides of the substrate contains an antioxidant.

15. Ink-jet recording material in accordance with claim 14, wherein the antioxidant is hexamethylenebis(dimethylcarbazide).

16. Ink-jet recording material in accordance with claim 1, wherein the recording layer applied directly to one or both sides of the substrate has a Bekk smoothness of 60-150 sec.

17. Ink-jet recording material in accordance with claim 1, wherein the recording layer applied directly to one or both sides of the substrate has a glossiness in a range of 10-40%, as measured by TAPPI 450 or ISO 2813 at an angle of reflection of 75°.

* * * * *